United States Patent [19]

Sterling

[11] 4,135,746

[45] Jan. 23, 1979

[54] LATCH BOLT ASSEMBLY

[76] Inventor: John G. Sterling, 888 Country Club Rd., Crystal Lake, Ill. 60014

[21] Appl. No.: 769,586

[22] Filed: Feb. 17, 1977

[51] Int. Cl.[2] ..... E05C 5/00; E05C 15/02

[52] U.S. Cl. ..... 292/92; 292/71; 292/74; 292/192; 292/DIG. 65

[58] Field of Search ..... 292/70, 71, 74, 78, 292/92, 5, 21, 192, DIG. 16, DIG. 65, DIG. 71

[56] References Cited

U.S. PATENT DOCUMENTS

| | | | |
|---|---|---|---|
| 126,907 | 5/1872 | Skinner | 292/55 |
| 294,785 | 3/1884 | Jackson | 292/74 |
| 326,626 | 9/1885 | Chubb et al. | 292/78 |
| 344,722 | 6/1886 | Clark | 292/78 |
| 391,911 | 10/1888 | McIntire | 292/74 |
| 490,517 | 1/1893 | Steuerwald et al. | 292/227 |
| 2,288,145 | 6/1942 | Siegfus | 292/78 |
| 2,510,326 | 6/1950 | Anderson | 292/192 X |
| 2,581,606 | 1/1952 | Seaman et al. | 292/74 |
| 2,586,900 | 2/1952 | Alderman | 292/74 |
| 2,686,071 | 8/1954 | Saxton et al. | 292/71 |
| 3,107,112 | 10/1963 | Schlage | 292/192 |
| 3,124,378 | 3/1964 | Jackson | 292/5 |
| 3,951,442 | 4/1976 | Schlage | 292/71 |

FOREIGN PATENT DOCUMENTS

| | | | |
|---|---|---|---|
| 380268 | 9/1932 | United Kingdom | 292/74 |
| 592984 | 10/1947 | United Kingdom | 292/74 |

*Primary Examiner*—Roy D. Frazier
*Assistant Examiner*—William E. Lyddane
*Attorney, Agent, or Firm*—McCaleb, Lucas & Brugman

[57] ABSTRACT

A bolt assembly for use with interior door latches or locks embodying a movable latch bolt and a relatively movable strike engaging latching element normally activated with the bolt to engage and disengage a jamb mounted strike in response to actuation of manual operator means having associated locking means operable to prevent operator actuation of the bolt and latching element for purposes of locking the door. In such locked state, emergency opening of the door may be accomplished with the assembly of this invention by imposing appropriate force on the latching element to effect strike disengaging movement thereof relative to the bolt.

12 Claims, 37 Drawing Figures

Fig. 29.
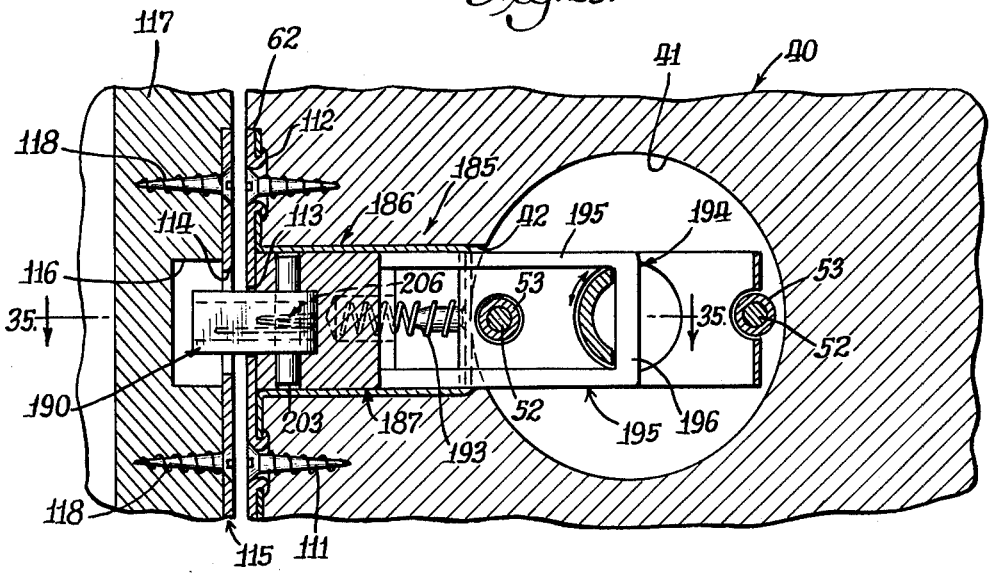
Fig. 31.
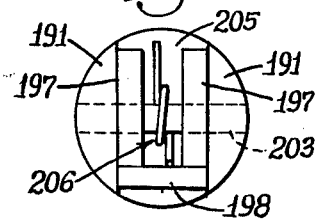
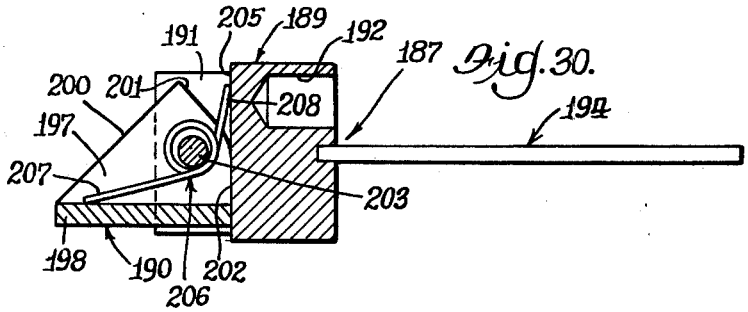
Fig. 30.
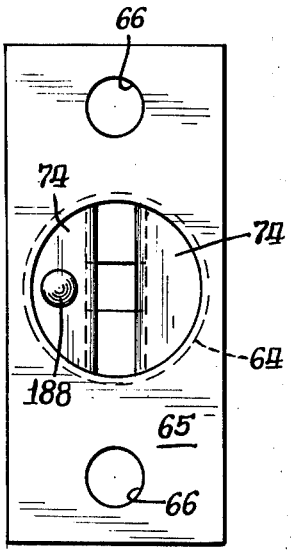
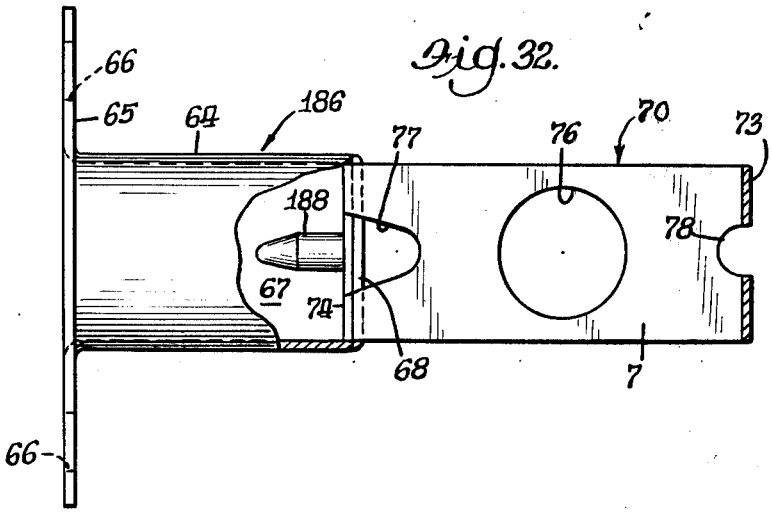
Fig. 32.
Fig. 33.
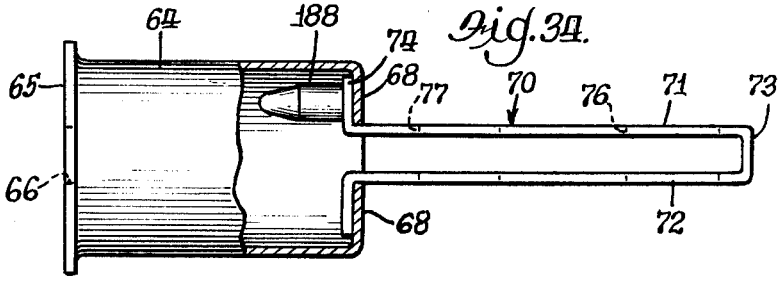
Fig. 34.

LATCH BOLT ASSEMBLY

BACKGROUND OF THE INVENTION

Historically, exterior door locks have been developed as security devices to make forced entry through a locked door as difficult as possible. This same basic concept has been carried over into the design for interior door locks, although the requirements for the two are obviously distinct, especially from a security standpoint. For all intents and purposes, interior doors require little more than a simple latching device to maintain a door closed against unintentional opening, as by a draft of air. Possible exception to this is found in locks used on doors for bathrooms, bedrooms and dressing rooms where a measured degree of privacy and security is desired.

Because of basic adherence to exterior door lock design, heretofore known interior door latches and locks have exhibited serious disadvantages, especially in their inability to be unlocked quickly if broken or jammed or in emergency situations. As a result, it is all too common for individuals to lock themselves in a room, making emergency entry through the locked door necessary. In order to alleviate this problem, some manufacturers have provided special implements or tools whereby emergency opening of the door lock may be effected. In panic situations, however, those emergency entry provisions are often too time consuming or fail entirely.

SUMMARY OF THE INVENTION

The present invention is addressed to the above outlined problem and provides a unique and simple solution thereto.

This invention relates in general to door hardware and more particularly to improved bolt assemblies especially useful with interior door latches or locks.

In brief, the hereinafter described preferred and modified embodiments of this invention employ a novel concept for a bolt assembly, adapted for use with edge or surface mounted door latch and lock assemblies, either as original or replacement equipment. A movable latch bolt cooperates with a latching element, which is movable with the bolt and also relative thereto; the latching element being engageable with a stationary jamb mounted strike to keep a door in closed position over a door opening. In normal usage, the bolt and latching element move together in response to actuation of operationally associated operator means. Locking means are provided whereby operator induced unlatching operation of the bolt and latching element may be prevented. Desired emergency opening and unlatching of a locked door is permitted, however, by imposing sufficient thrust or pull force on the assembly to move the latching element relative to the bolt whereby to disengage the same from the strike. Such emergency unlatching operation of the improved bolt assembly of this invention is brought about without the necessity of special instruments or tools and may be accomplished conveniently and quickly with minimum effort.

Among the important objects of this invention is the provision of an improved bolt assembly having emergency unlatching capability.

Still another important object of this invention is to provide an improved bolt assembly for use with door latches or locks, either as original manufacture or replacement equipment.

An additional object of this invention is to provide an improved bolt assembly, as aforesaid, which is normally actuated by manual operator means to engage and disengage a jamb mounted strike and which has the additional capability of being actuated to escape the strike independently of the operator means.

A still further important object of this invention is to provide an improved bolt assembly, particularly useful with interior door latches and locks, comprising a latching element which is operatively responsive to the movements of a manually controlled latch bolt, but has the further capability of moving relative thereto in response to appropriately imposed forces, whereby to permit door unlatching operation thereof independently of the associated manual operator.

Having thus described this invention, the above and further objects, features and advantages thereof will appear from the following description of preferred and modified embodiments thereof illustrated in the accompanying drawings, and representing the best mode presently contemplated to enable those of normal skill in this art to make and practice the same.

IN THE DRAWINGS

FIG. 29 is an enlarged cross-sectional view, with parts shown in side elevation, similar to FIG. 3, illustrating a third modified bolt assembly, according to this invention;

FIG. 30 is an enlarged top plan view, with portions shown in section, of the plunger subassembly employed in the FIG. 29 assembly;

FIG. 31 is a lefthand end view of the plunger assembly illustrated in FIG. 30;

FIG. 32 is a side elevational view with portions broken away in section of a housing and the yoke subassembly employed with the plunger subassembly of FIG. 30;

FIG. 33 is a lefthand end view thereof;

FIG. 34 is a top plan view of the FIG. 32 subassembly with portions thereof broken away in section.

DESCRIPTION OF PREFERRED EMBODIMENT

Figure 1:
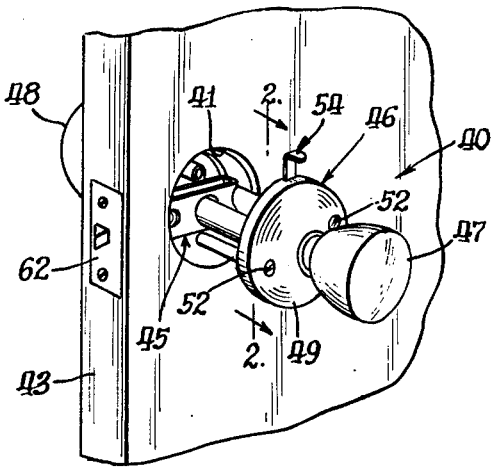
FIG. 1 is a partial perspective view of an interior door and lockset embodying a latch bolt assembly according to this invention.

Turning now to the particulars of the preferred embodiment of this invention, illustrated in FIGS. 1 through 12 of the drawings, initial reference is made to FIG. 1 wherein a portion of a typical interior door 40 is shown as having an enlarged bore 41 extending therethrough which is traversed by a secondary bore 42 (see FIG. 3) extending inwardly of one outer or free edge 43 of the door for reception of a latch bolt assembly 45 of this invention.

Figure 10:
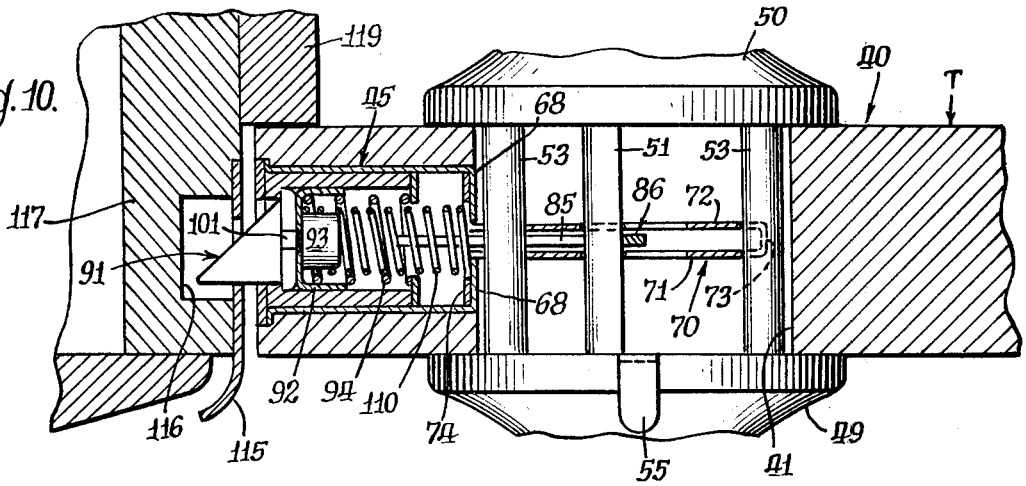
FIG. 10 is a cross-sectional view with parts in plan, taken substantially along vantage line 10—10 of FIG. 3 and looking in the direction of the arrows thereon, illustrating the door mounted latch bolt assembly of this invention in latched condition with a jamb mounted strike.

The enlarged bore 41 is provided for purposes of mounting a manual operator means 46 comprising an inside operating knob 47, an outside operating knob 48, each with an associated knob rose 49 and 50, respectively, mounted on opposite faces of the door over the opening 41 (see FIG. 10). A knob spindle 51 extends through the door opening 41 and the bolt assembly 45, while a pair of mounting bolts 52, 52 thread into cylindrical mounting bosses 53 to interconnect the knob roses and maintain the operator means 46 in mounted position on the door.

Lock means, comprising a locking slide 54 (see FIGS. 2 and 10) equipped with a manually engageable handle portion 55, accessible outwardly of the interior knob rose 49, is slidingly mounted to operationally lock and release the rotatable knob spindle 51 and the bolt assembly 45, as will appear presently.

It is to be noted that the above described operator means 46 is generally of conventional, known construction and makeup. The particular structure for the manual operator means associated with the improved bolt assembly of this invention is of no particular consequence to the merits of the latter except as to provide manually operable means for actuating the bolt assembly and suitable means for locking the same. Consequently it is fully contemplated that various styles and types of operator means may be employed, such as the rotatable door knob assembly shown, push-pull knobs, a lever handle, or other known structures. In a similar manner, the particulars of the illustrated lock means is generally immaterial to the present invention except to provide means for selectively preventing manual operation of the bolt assembly.

With special regard to the herein illustrated operator assembly 46, however, it will be appreciated that the knob spindle 51 extends through the door opening 41 and has the two door knobs 47 and 48 fixed to and mounted over its outer ends in known manner. The mounting screws 52 likewise extend through the inside knob rose and opening 41, each to threadingly engage an opposing one of the mounting bosses 53 which project from the inside face of the exterior knob rose 50 (see FIG. 10) per conventional practice.

Figure 2:
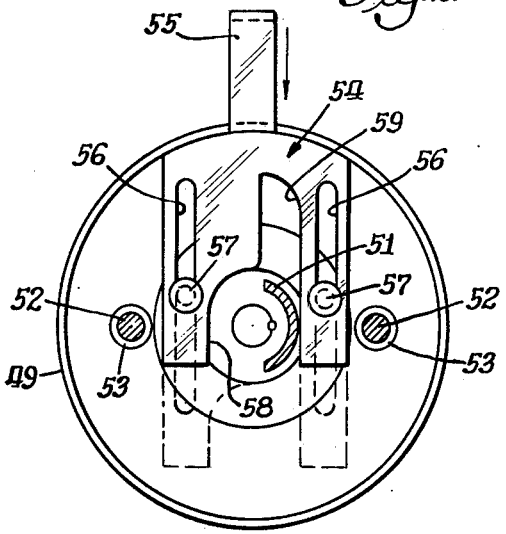
FIG. 2 is a sectional view of the manual operator means illustrated in FIG. 1 with parts in elevation, taken substantially along vantage line 2—2 of that figure.

With regard to the specific locking means shown, the illustrated mechanism includes the slide plate 54 having guide slots 56, 56 riding over spaced guide posts or rivets 57, 57 projecting inwardly from the inside of knob rose 49. Slide plate 54 is formed with a central open portion 58 communicating with the lower edge of the plate and having an upwardly extending, elongated channel portion 59 which is operatively aligned over a central semicylindrical section of the knob spindle 51 when the latter is rotated to its neutral operating position as shown in FIG. 2. Upon downward sliding movement of plate 54, the channel portion 59 embraces the neutral positioned knob spindle 51 to effectively prevent its rotational movement, thereby locking the same in its neutral position. This effectively arrests and rotatably locks the operating spindle and door knobs and resultantly prevents manual actuation of the associated bolt assembly 45. This locked or arrested condition of the knob spindle is depicted in each of the drawing FIGS. 10–12 for purposes of illustrating force imposed operation of the bolt assembly 45 according to this invention. It is to be understood, of course, that under normal conditions, rotational movements of this knob spindle 51 serve to manually operate latch bolt assembly 45 moving the latch bolt between latching and unlatching positions. Return of the knob spindle to its FIG. 2 neutral position is effected by return spring means (not shown), but conventionally associated with the operator means.

Figure 3:
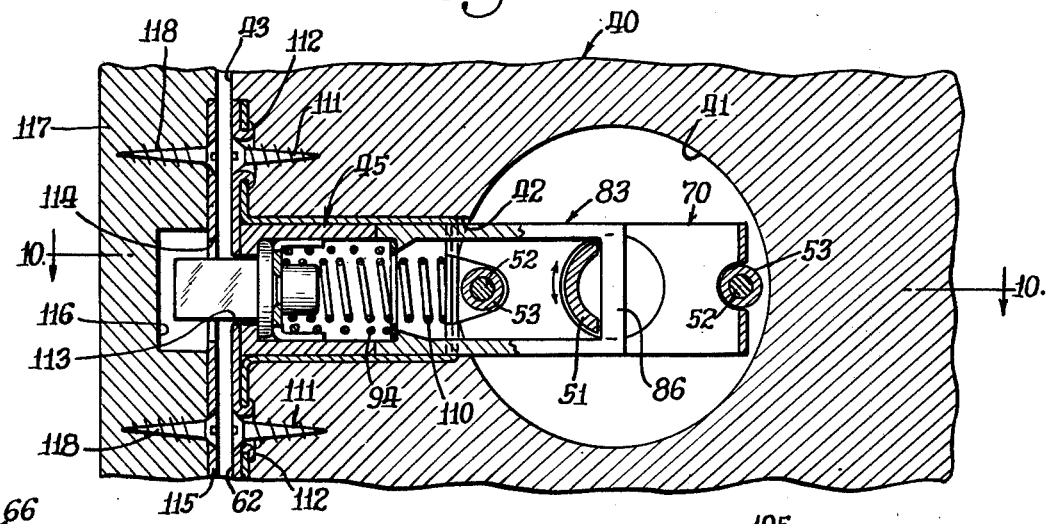
FIG. 3 is an enlarged cross-sectional view, with parts in elevation, illustrating a preferred form of latch bolt assembly, according to this invention, mounted on a door.
Figure 4:
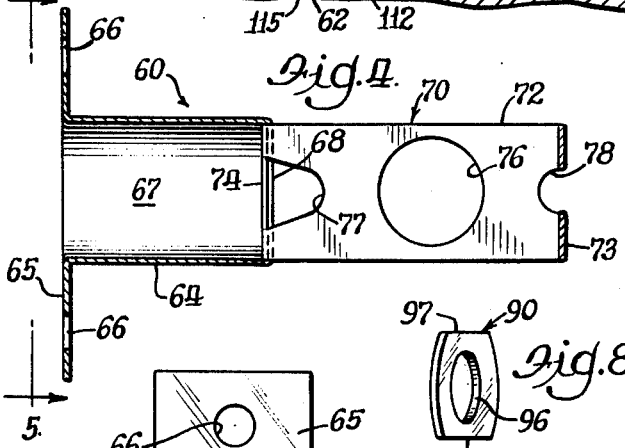
FIG. 4 is a side elevational view of a latch bolt housing and yoke assembly illustrated in FIG. 3.
Figure 5:
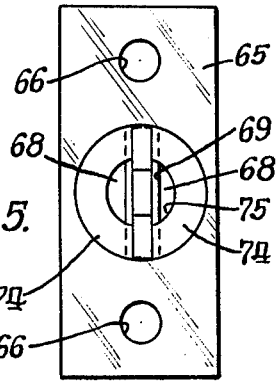
FIG. 5 is an end elevational view taken substantially from vantage line 5—5 of FIG. 4.
Figure 6:
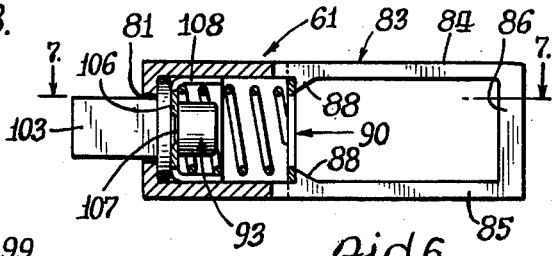
FIG. 6 is a side elevational view, with parts broken away in section, of a plunger subassembly used with the housing subassembly of FIG. 4.
Figure 9:
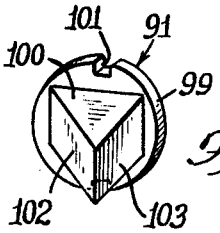
FIG. 9 is a perspective view of a latching element used in the subassembly of FIGS. 6 and 7.

Turning now to the features of the latch bolt assembly 45 as illustrated in FIGS. 3–12 of the drawings, in general such may be considered as comprising two major subassemblies, namely a plunger housing and yoke assembly 60, shown in FIG. 4, and a plunger assembly 61, illustrated in FIG. 6. These two subassemblies are cooperatively interfitted with the plunger assembly 61 mounted for coaxial sliding movement within the housing and yoke assembly 60. Assembled relationship of the two subassemblies is maintained by a face plate 62 fixed over the open end of the housing assembly 60, as best illustrated in FIG. 3 of the drawing.

In more specific detail, assembly 60 is formed with a cylindrical tubular housing 64 having an outside diameter acceptable in the transverse bore 42 extending inwardly of the door edge 43. Preferably housing 64 is formed integrally, as by a drawing operation, with a rectangular shaped planar mounting flange portion 65 having spaced mounting screw openings 66 therein. From FIG. 4 it will be noted that the cylindrical housing 64 confines an internal cylindrical chamber 67 open at one end and extending centrally inwardly of the flange portion 65, with the spaced screw openings 66 aligned along the central lengthwise axis of the flange portion (see FIG. 5). The opposite or inner end of housing 64 is partially closed by radially inwardly extending symmetrical end wall portions 68, 68 (see FIGS. 5 and 10) which are separated by a central and generally rectangular shaped opening 69 receptive of the yoke member 70 in assembly. (See FIG. 5).

The yoke member 70, as best shown in FIGS. 4 and 10 through 12, comprises a generally U-shape metal stamping having a pair of parallel spaced, elongated arm portions 71 and 72 joined at their innermost ends by a cross-connecting inner end wall 73. The opposite or outer end of each of the arm portions is turned outwardly at right angles and formed to provide a pair of semiannular mounting ears 74, 74 (see FIGS. 5 and 10), which are adapted to fit inside of chamber 67, engaging the end wall portions 68, 68 of the housing 64, as best shown in FIGS. 4 and 10–12. The mounting ears 74 may be fixed to the wall portion 68, 68 as by spot welds or alternatively may merely frictionally interfit therewith as shown. It further is to be noted that the semiannular formation of the mounting ears 74 provides a circular spring seat or shallow socket 75 coaxially of the housing 64 for purposes of seating one end of spring means, as will be described hereinafter.

As best recognized from FIGS. 3, 4 and 10 of the drawings, the parallel yoke arms 71 and 72 are provided with registeringly aligned, large circular openings 76, located generally medially thereof, while additional smaller openings 77 are provided adjacent the mounting ears 74 and semicircular cutaway openings 78 are provided at the innermost end of each arm, cutting through the cross-connecting wall 73 of the yoke. Openings 77 and 78 provide passageways for the mounting bosses 53 when mounting the operator assembly 46 over the door opening 41. In a corresponding manner, the enlarged central openings 76 provide passage for the operating knob spindle 51; such openings 76 being of sufficient size to accomodate free rotational movements of that spindle as occurs with manipulation of the operator knobs 47 and 48.

Turning now to the features of the plunger assembly 61, reference is made to FIGS. 6 through 9 of the drawings. As therein shown, assembly 61 comprises a generally cylindrical plunger member 80 closed over at its outer end by a front wall having a rectangular shaped opening 81 which communicates with a cylindrical interior chamber 82 of the plunger member. Fastened to the inner end of plunger member 80, and aligned with the longitudinal axis thereof, is a rearwardly extending tail piece 83 formed generally U-shape and having operationally oriented upper and lower arms 84, 85 interconnected at their inner ends by a transverse cross arm 86 (see FIG. 6). The arms 84 and 85 are parallel, and are suitably spaced to align with the exterior of the plunger member in assembly. To that purpose the outer ends of the arm portions 84 and 85 are inserted in diametrically opposed openings cut in the inner end of the plunger member 80 and are brazed or otherwise fixed thereto, as indicated generally at 87. Immediately adjacent the inner end of the plunger member 80 and its areas of junction with the arm portions 84, 85 are radially inwardly extending retaining tabs 88 projecting integrally from arms 84, 85 to provide aligned abutments for supporting a washer-like spring retainer 90 (see FIG. 8), as will be described in greater detail presently.

Mounted within chamber 82 of the plunger member is a movable latching element 91, a spring cup 92 having a coaxially extending plunger spring guide 93 and a latching element spring 94 extending between the bottom or closed end of cup 92 and the removable spring retainer 90.

Figure 7:
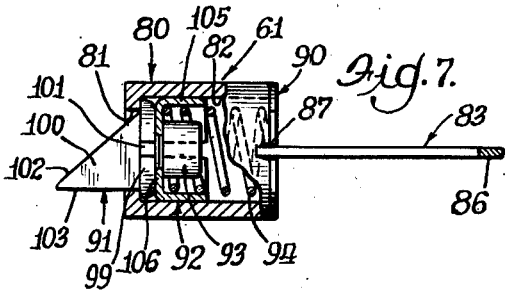
FIG. 7 is a cross-sectional view with parts in plan taken along vantage line 7—7 of FIG. 6 and looking in the direction of the arrows thereon.
Figure 8:
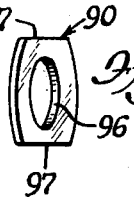
FIG. 8 is a perspective view of a spring retainer used in the subassembly of FIGS. 6 and 7.

As shown best in FIG. 8, the spring retainer 90 is formed as an annular metal washer having a central cylindrical opening 96 and distinguished by a pair of parallel spaced, chordal flats or linear edges 97, 97, which are spaced to fit between the spaced arm portions 84, 85 of the tail piece. Thus the retainer may be slipped transversely between arms 84, 85 in operation as shown in FIGS. 6 and 7, thereby partially closing the open end of chamber 82 and providing support for the inner end of the latching element spring 94. It will be noted that the mounted retainer 90 abuts the projecting retaining tabs 88, 88 of the tail piece. In assembly the retainer member 90 is positioned between the tabs 88 and the adjacent end of plunger member 80, after first inserting the latching element, spring cup and spring 94 in chamber 82, with the walls of plunger housing 64 holding the retainer in operating position.

Turning now to the specific aspects of the movable latching element 91, (best shown in FIGS. 6, 7, and 9), it will be recognized that the same is a unitary member comprising a generally thin cylindrical base portion 99 with a radiused outer edge and a wedge shape latch engaging nose portion 100 projecting from its frontal wall. Preferably, the latching element 91 is molded or cast of metal, such as zinc base alloys; or a suitable plastic having good wear characteristics, such as nylon, may be used. It will be noted that the base portion 99 includes a pair of diametrically opposed rectangular notches or cutaway openings 101 which are aligned and passed over the depending retaining tabs 88 of the tail piece when inserting the latching element coaxially into chamber 82 of the plunger member. The latch engaging nose portion 100 of the latching element is distinguished by a generally triangular shaped plan profile, as best illustrated in FIG. 7, and includes a pair of angularly intersecting side walls 102 and 103, the latter of which is disposed at right angles to the frontal wall of its base portion 99; the depth or height of the walls 102 and 103 being dimensioned for passage of the nose portion through the rectangular opening 81 in the outer end wall of the plunger member 80 in operation (see FIG. 3). It also will be noted that the diameter of the cylindrical base portion 99 is substantially equal to that of chamber 82, leaving sufficient clearance to permit free rocking or semirotational movement of the latching element within that chamber as will be recognized from the operational description which follows.

The spring cup 92 is formed with a generally cylindrical side wall 105 and is closed over at one end by a bottom wall 106 which is operationally engaged by the base portion 99 of the latching element. Wall 106 is formed with a central opening receptive of a rivet head portion 107 extending coaxially from one end of the plunger spring guide member 93 whereby the latter is rigidly affixed to the spring cup.

As best shown in FIGS. 6 and 7, the plunger spring guide 93 comprises a generally cylindrical metal button fitted concentrically within the spring cup to provide a guide for one end of a plunger spring, as will appear presently. Inasmuch as the spring cup and attached spring guide are insertable into chamber 82 of the plunger member in the same manner as that described for inserting the latching element therein, the spring cup is likewise provided with a pair of diametrically opposite cutaway channels or slots 108 (see FIG. 6) for clearing the inwardly extending retaining tabs 88, 88 of the tail piece in assembly.

The latching element spring 94 associated with the plunger assembly 61 comprises a compression coil spring which is inserted coaxially into chamber 82 with one end thereof engaging the bottom wall 106 of the spring cup 92. The opposite end of latching element spring 94 abuts the retainer washer 90 which is thereby pressed tightly against the depending retaining tabs 88, 88 of the tail piece in final assembly. It will be appreciated that the latching element spring 94 resiliently pushes the latching element toward the front wall of the plunger member to maintain the chisel-like nose projection 100 thereof extending outwardly through opening 81 of the plunger member.

Figure 11:
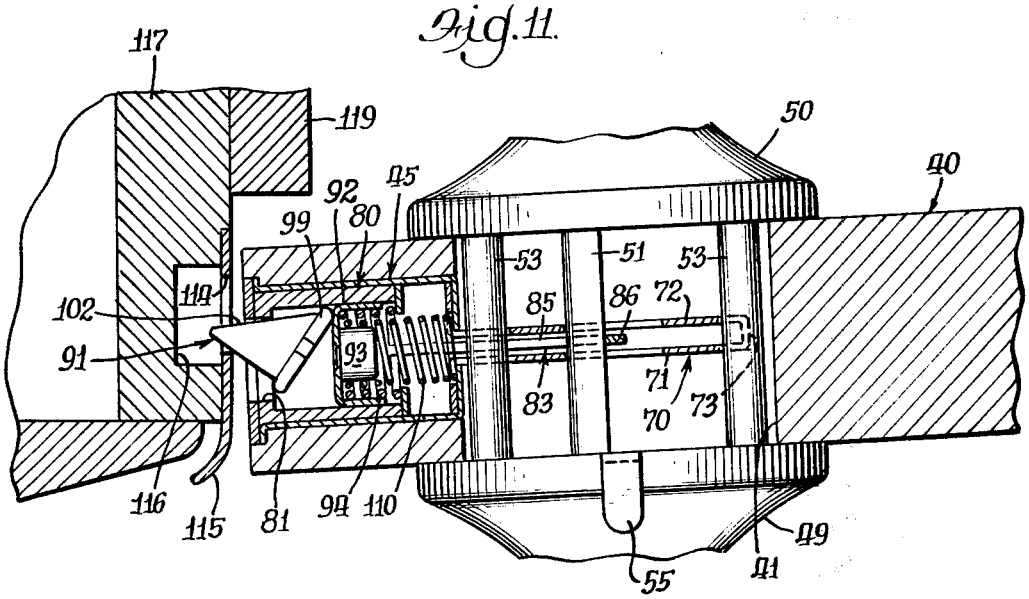
FIG. 11 is a cross-sectional view, similar to FIG. 10, illustrating an initial positioning of parts for the FIG. 10 latch bolt assembly during force imposed unlatching operation.
Figure 12:
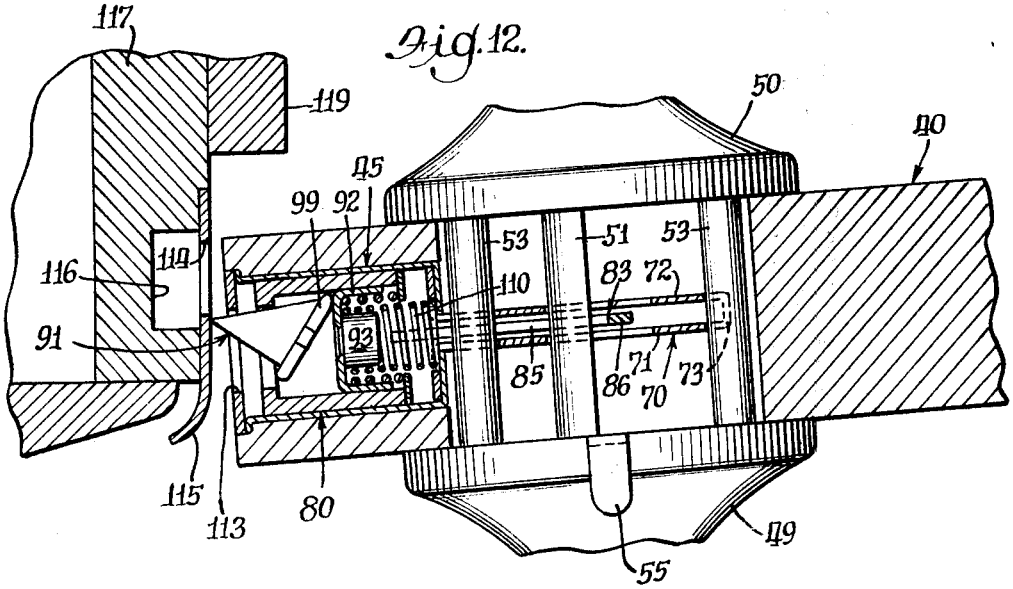
FIG. 12 is another cross-sectional view, similar to FIG. 11, illustrating the unlatched condition of the FIG. 10 assembly.

Having thus described the housing and plunger assemblies 60 and 61, it will be recognized from FIG. 3 that assembly 61 is fitted coaxially within the housing assembly 60 with the tail piece 83 of the former extending between the spaced arm portions 71 and 72 of the yoke member (also see FIGS. 10–12). It is to be noted that in addition to the described latching element spring 94, a plunger spring 110, generally longer, of smaller diameter and of less compressive strength than the latching element spring 94 is provided to oppose operating movements of the plunger assembly inwardly of the housing assembly. Specifically, spring 110 has its outer end disposed about the centrally located plunger spring guide 93, concentrically inwardly of the larger diameter latching element spring 94, to extend rearwardly through the central opening 96 of the spring retainer and into the spring seat 75, formed by the generally semicircular yoke mounting ears 74, 74. In this respect it will be recognized that the inner end of the plunger spring 10 abuttingly engages the inner end wall portions 68 of the plunger housing 64.

Once the plunger assembly 61 is coaxially mounted in the plunger housing assembly 60, with the plunger spring 110 extending therebetween as above noted, the two subassemblies are maintained in their organized relationship by means of the face plate 62. The face plate 62, as best shown in FIGS. 1 and 3 of the drawings, comprises a generally conventional, rectangular shaped metal plate, conforming to flange 65 of the plunger housing 64 and adapted to be mounted in a suitable recess formed inwardly of the free door edge 43, according to known practice. Plate 62 is provided with appropriately spaced mounting screw openings registeringly aligned with the corresponding screw opening 66, 66 of the mounting flange whereby to provide for the passage of mounting screws 111. Positive interconnection of plate 62 and mounting flange 65 is effected by means of tubular protrusions, formed by upsetting material from the plate 62 when forming the screw openings therethrough and which protrusions are riveted over behind the mounting flange 65 in final assembly, as indicated at 112 in FIG. 3. Plate 62 also includes a generally centrally disposed rectangular opening 113 (FIG. 3) for passage of the latching element's nose portion whereby the latter may enter an opposing opening 114 in a stationary jamb mounted strike 115; opening 114 lying over a recess 116 provided in the jamb member 117. As shown, strike 115 is conventionally held in place by suitable mounting screws 118 or the like.

It will be appreciated that once the bolt assembly 45 is mounted in the bore 42 of the door, as above described, and the face plate 62 affixed to the door edge by the mounting screws 111, the manual operator assembly 46 is readily mounted over the transverse door opening 41 by inserting the operating spindle 51 thereof through the enlarged opening 76 of the yoke member and between the arms 84, 85 of the tail piece 83. The mounting bosses 53 pass through their respectively associated openings 77 and 78 of the yoke member and the knob roses are then interjoined by threading the mounting screws 52 into the aligned bosses 53 to complete installation of the lockset.

Use and Operation of Preferred Embodiment

Use and operation of the latch bolt assembly 45 heretofore described, will best be understood with specific reference to FIGS. 10 through 12 of the drawings. As previously noted, assembly 45 normally responds to rotational activity of the operating spindle 51 as imposed by manipulation of either of the operating knobs 49 or 50, particularly in retracting the plunger assembly to open the door. As mentioned, release of the operating knobs automatically returns the plunger assembly to its normal extended or latching position for engagement with the strike by virtue of the plunger spring 110 of the bolt assembly. However, in the event the door is closed and the lock means 54 is activated to lock the operating spindle 51, as described, thereby preventing manual unlatching operation of the bolt assembly 45, emergency opening of the latch door may be accomplished, according to the concepts of this invention, independently of the operator means. This function is brought about by applying appropriate force on the door (as indicated by directional arrow T in FIG. 10). Such force may be thrust applied against the outside of the door, as indicated, or alternatively may be a pull force applied to the inside operating knob 47, for example. In either event, however, the forces are applied transversely to the normal operating axis of the latching element as imposed by its responsive operational movements with the bolt plunger assembly 61. As previously noted, the operational condition illustrated in FIGS. 10 through 12 of the drawings is one in which the operating spindle 51 is locked against rotation by virtue of selected actuation of the lock means 54. With that in mind, imposition of thrust or pull forces on door 40 initiates unlatching operation of the latching element, as shown in FIG. 10, independently of the manual operator means 46; the intermediate opening positioning of parts being substantially as illustrated in FIG. 11. As there shown, the latching element 91 rotatably reacts to the door imposed opening forces, moving clockwise relative to the plunger member 80. More specifically, face 103 of the latching element nose piece projection is forced against an adjacent side edge of the opening in strike 115 while the door 40 moves away from the door stop 119 in an opening direction. As a consequence of this activity the base of the latching element assumes an angular disposition with respect to the movement axis of the plunger member 80 and arrives at a state, as illustrated in FIG. 11, wherein the base wall of the latching element lies angularly across the translating axis of the plunger member, at approximately 45°. In so moving, the base wall of the latching element forces the spring cup 92 inwardly relative to the plunger member and along the axis of chamber 82 to compress the latching element spring 94. It should be noted that during this initial activity, the plunger member 80 and tail piece 83 may momentarily remain relatively stationary in their advanced positions, as shown in FIG. 10. Inasmuch as the spring cup 92 moves inwardly relative to the plunger member 80 some compression of the plunger spring 110 also takes place which gradually increases with rotational movement of the latching element. Ultimately rotational movement of the latching element reaches a limit, substantially as illustrated in FIG. 11, wherein the second face wall 102 of the nose piece approaches the opposite side edge of the opening 81 in the plunger member. At this point, continued movement of the door in an opening direction serves to bodily thrust the latching element axially inwardly of the plunger member 80, as effected by the angulated engagement of the latching element face 103 with the adjacent side edge of the opening 114 in strike 115. Such inward translation of the latching element displaces the spring cup until the compression of latching element spring 94 produces sufficient rearward thrust or force on the retainer 90 to move the entire plunger assembly 61 in an unlatching direction relative to the housing assembly 60, as shown in FIG. 12 of the drawings. This activity is tantamount to the normal unlatching movements of the plunger and tail piece as normally imposed by rotational movement of the operator spindle 51. When such inward translation of the plunger and tail piece is sufficient to effectively disengage the latching element from the strike plate opening, full release of the latching element takes place as shown in FIG. 12. Thus the desirable emergency door opening objective of this invention is accomplished by the mere imposition of appropriate forces against the locked door.

As soon as the latching element has cleared the strike, the two spring members start to expand to rotatably reverse the latching element and to return the plunger assembly to its normal latching condition, as depicted in FIG. 10. That is to say, the latching element spring 94 acts to move the spring cup toward the outer end of the bolt assembly, rocking the latching element back to its normal aligned condition with the spring cup while the plunger spring 110 serves to move the plunger assembly to its normal latching position, as shown in FIG. 10. Thus the bolt assembly is reconditioned for normal manual operation and is ready for reengagement with the strike.

First Modified Form

Turning now to FIGS. 13 through 16 of the drawings, a first modified latch bolt assembly 125, shown in operating position on door 40 will now be described. This assembly, as with the first described assembly 45, is used in conjunction with the previously described manual operator means 46 and is mounted on door 40 for cooperation with opening 114 in the stationary jamb mounted strike 115 in the same manner as previously related.

In brief, modified assembly 125 comprises two basic subassemblies, namely, the same plunger housing assembly 60 described heretofore and a modified plunger assembly 126. A slightly modified face plate 127 cooperates with the housing assembly 60 to maintain the plunger assembly 126 in assembled relationship therewith.

It will be recalled that the housing and yoke assembly 60, as detailed in FIGS. 4 and 5 of the drawings, includes a tubular housing 64 having an integrally formed mounting flange 65 at one end and interfitted with a rearwardly extending U-shaped yoke 70 having parallel spaced arms 71, 72. Inasmuch as the various portions and elements of assembly 60 have been heretofore described in detail, the same will not be repeated. However, the corresponding parts and portions thereof appearing in FIGS. 13 through 16 are numbered as previously set out and will be referred to accordingly from time to time in conjunction with the following description of the modified assembly 125.

Figure 13:
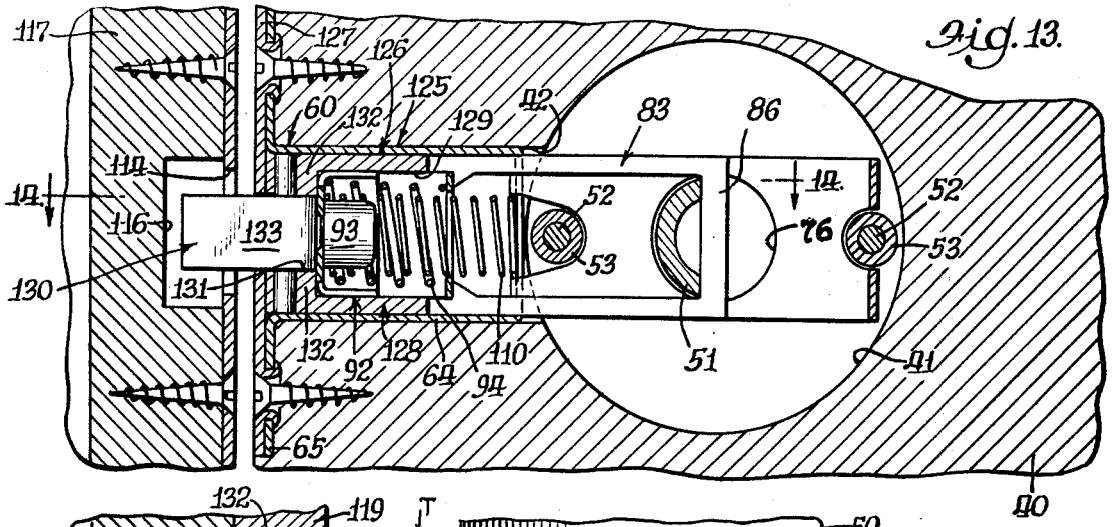
FIG. 13 is an enlarged cross-sectional view, with parts shown in elevation, similar to FIG. 3, illustrating a modified form of latch bolt assembly according to this invention.

It will be observed that the basic modifying differences between assembly 125 and the first described assembly 45 reside in the plunger assembly 126. As best shown in FIG. 13, the plunger assembly includes a modified cylindrical plunger member 128 having an internal cylindrical chamber 129 opening coaxially inwardly of its inner end. The previously described tail piece 83 is affixed to the inner end of this plunger member 128, and extends rearwardly therefrom, while the previously described spring cup 92 with its cylindrical spring guide 93 is mounted within chamber 129 to guide and contain the outer ends of the coaxial compression springs 94 and 110, all as in the first described plunger assembly 61. Also it will be observed that the heretofore described spring retainer 90 is mounted across the inner end of the chamber 129 and bears against the depending retaining tabs 88, 88 of the tail piece for supporting the inner end of the latching element spring 94. The longer plunger spring 110 extends through the retainer 90 and has its inner end located in spring seat 75, bearing against the end wall portions 68, 68 of the housing 64, as previously related. Thus it will be recognized that the mounting the housing of the springs and spring cup within the cylindrical chamber 129 of the modified plunger member 128 is for all intents and purposes the same as first described plunger assembly 61.

Figure 14:
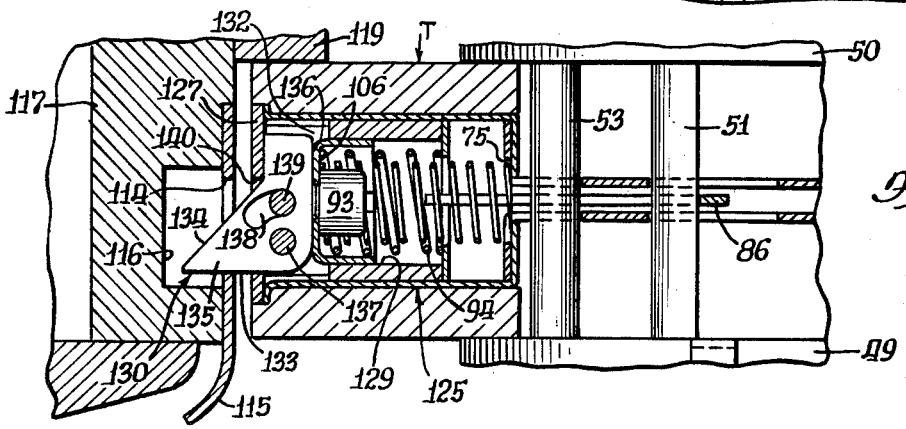
FIG. 14 is another cross-sectional view of the FIG. 13 assembly, with portions shown in plan, taken substantially along vantage line 14—14 of FIG. 13 and illustrating the positioning of parts in fully latched condition with a jamb mounted strike.

The major differences and distinction between plunger assembly 126 of FIGS. 13–16 and the corresponding first described assembly 61, reside in the construction of the plunger member 128 and the associated relatively movable latching element 130 carried therewith. Specifically, as shown in FIGS. 13 and 14, plunger member 128 is distinguished by an operationally disposed horizontal cut-away slot or opening 131 which bifurcates its outer end and openly communicates with the internal chamber 129. Due to this construction, the outer end of the plunger member presents a pair of parallel spaced, semiarcuate end portions 132, 132 which fit closely over and under the latching element 130 which is mounted therebetween.

As seen in FIGS. 13 ∝ 16, latching element 130 is formed substantially as a bell crank and includes a pair of angularly intersecting nose walls 133 and 134 which are related at substantially 45° to form a projecting nose piece or portion 135 at the outer end of the latching element. Wall 133 of the nose piece also intersects a planar base wall 136 disposed at right angles thereto; the junction therebetween merging at a radiused corner. Such base wall normally engages the adjacent front end wall 106 of the spring cup when the latching element is in its latching position, as illustrated in FIG. 14. It will be recognized that wall 136 comprises an extended lever arm at the base or inner end of the latching element which reaches across the end wall 106 of the spring cup 92.

The modified latching element 130 is pivotally supported between the separated end portions 132, 132 of the plunger member by means of a cylindrical pivot pin 137, the axis of which is located to one side of the central longitudinal axis of the plunger assembly in parallelism with the tail piece 83. Pin 137 provides a positive connection whereby the latching element is secured to the plunger member for movement therewith within the interior of housing 64. At the same time the latching element is also pivotal about the axis of pin 137 relative to the plunger member 128. Further modification of the latching element is provided by way of an arcuate shaped opening 138 located to one side of the mounting pin 137 and through which a secondary stop pin 139 extends parallel to pin 137. By virtue of the arcuate slotted opening, movement of the latching element about pin 137 is limited by engagement of the stop pin 139 with the ends of opening 138. Both the stop pin and the mounting pin extend through the latching element and the spaced end portions 132, 132 of the plunger member, as best illustrated in FIG. 13.

The assembled relationship of the plunger assembly 126 coaxially within the housing and yoke assembly 60 is maintained by virtue of the modified face plate 127 which is riveted to flange 65 of housing 64 in the same manner as the heretofore described interconnection of face plate 62 with the mounting flange of housing assembly 60. It is to be noted in particular that face plate 127 is the same size and shape and is otherwise identical to plate 62 of the first assembly 45, except for the size and location of the rectangular opening 140 provided for passage of the angulated nose portion 135 of the latching element. Specifically, opening 140 is not symmetrical of the vertical center line or axis of the plate 127, but is offset to one side of such axis to accommodate the off-center positioning of the latching element.

As with the first described latching element 91, its modified counterpart 130 in assembly 125 cooperates with opening 114 in the stationary strike 115 which is mounted over the recess 116 formed in the door jamb 117.

Use and Operation of First Modified Form

With particular reference to FIG. 14 of the drawings, it will be recognized that modified bolt assembly 125 is therein shown in its latched condition with the stationary strike 115 mounted on door jamb 117. As such, the movable latching element 130 is in extended condition whereby the nose portion 135 thereof extends through the opening 140 in the face plate 127 and into the strike opening 114. It will be understood, as with the preferred assembly 45, that the illustrated operating condition of FIGS. 13 through 16 is one in which the knob operated spindle 51 is locked against rotation by the lock means associated with the operator means 46. As such, manual retraction of the bolt assembly is prevented although, according to the concepts of this invention, application of thrust force T against the outer face of door 40 serves to produce relative movement of the latching element to effect its escaping disengagement from the strike.

Figure 15:
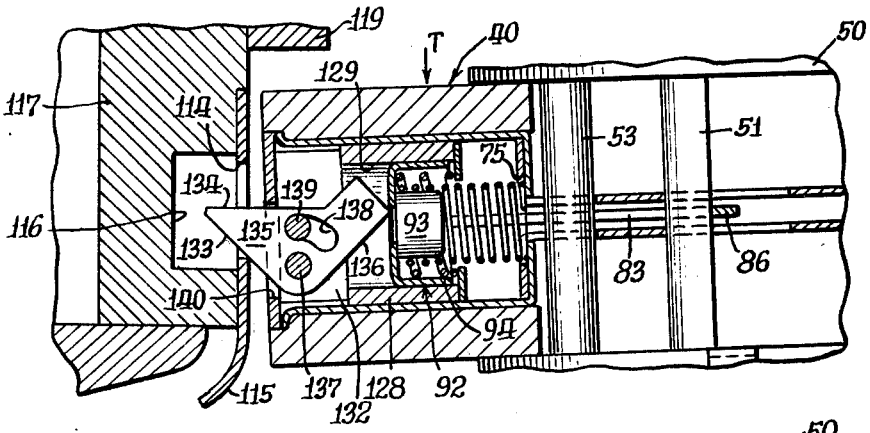
FIG. 15 is another cross-sectional view, similar to FIG. 14, illustrating an initial positioning of parts for the FIG. 14 assembly during force imposed unlatching operation.

FIG. 14 is thus illustrative of the normal latched position of the bolt assembly 125. Upon application of thrust force T to the outside of door 40 (or conversely by applying pulling force to the inside thereof) the door starts to swing in an opening direction about its hinges, causing the latching element to pivot about its mounting pin 137 in a clockwise sense as viewed in FIG. 15. This pivotal activity is brought about by virtue of the engagement of the latching element nose wall 133 with the adjacent edge of the strike opening 114 and continues until the stop pin 139 abuts the outer end of the arcuate stop opening 138, in the manner illustrated in FIG. 15. In response to such rotational activity of the latching element, the spring cup 92 is moved inwardly along chamber 129, compressing the latching element spring 94 and the plunger spring 110. It will be noted that FIG. 15 is illustrative of an instantaneous positioning of parts, showing movement of the spring cup and springs relative to the plunger member 128.

Figure 16:
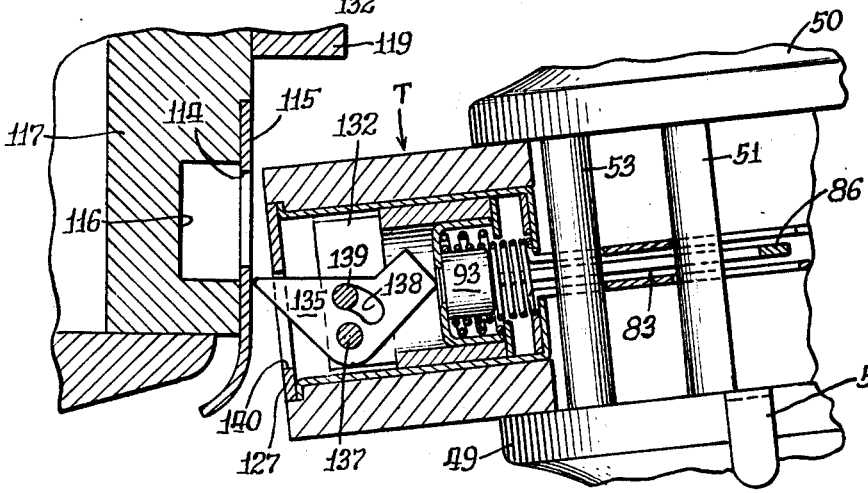
FIG. 16 is an additional sectional view, similar to FIGS. 14 and 15, illustrating the unlatched condition of the FIG. 14 assembly.

In response to further opening force on the door, the face wall 133 of the latching element, which is angularly engaged with the adjacent edge of the strike opening, (see FIG. 15), causes the latching element to translate bodily inwardly of the housing assembly 60, moving the plunger member 128 therewith and further compressing the plunger spring means 110. This activity effects sufficient inward translation of the entire plunger assembly to permit escape of the latching element from the strike opening 114 as illustrated in FIG. 16.

Thus it will be recognized that the modified assembly 125 operates in a manner similar to the first described assembly 45, to provide emergency opening of a door according to that important objective of this invention. As with assembly 45, once the door moves beyond the strike and door jamb, the latching element 130 is returned to latching position by the expanding activity of the springs 94 and 110, repositioning the parts of assembly 125 in latching condition.

Second Modified Form

A second modified form of the current invention is illustrated in FIGS. 17–28 of the drawings and, like the two previously described embodiments, such is operable to effect emergency opening of a locked door independently of an associated manual operator means.

Figure 17:
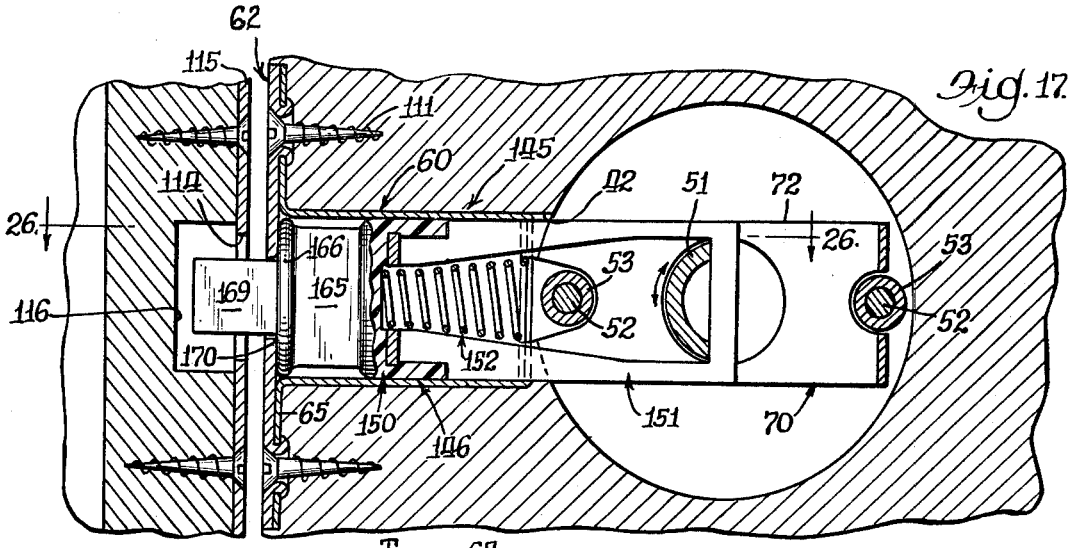
FIG. 17 is an enlarged cross-sectional view, with parts shown in full elevation, similar to FIG. 3, illustrating a second modified form of bolt assembly according to this invention.

As will best be recognized from FIG. 17, the modified latch bolt assembly 145 therein depicted is adapted to be mounted in the transverse bore 42 leading inwardly from the free edge 43 of the door 40 to cooperate with the previously described operator means 46 mounted over opening 41 therein. It also will be recognized that the assembly 145 cooperates with the stationary strike 115 affixed to the door jamb member 117 and more particularly cooperates with the strike opening 114 therein.

Inasmuch as the operator means 46 and the jamb mounted strike 115 are identical to the corresponding elements and parts previously set forth in association with the preferred assembly 45, such will not again be described in detail in conjunction with the second modified assembly 145.

From FIG. 17, in particular, it will be recognized that assembly 145 comprises two basic subassemblies, namely, the previously described plunger housing and yoke assembly 60 and a modified plunger assembly 146, as will be described in detail presently. The two subassemblies are maintained in their assembled relationship by means of the face plate 62 in the same manner described for assembly 45 and consequently the parts of assembly 60, appearing in FIGS. 17 and 26 through 28 of the drawings are designated by the same numbers as their counterparts appearing in FIGS. 1 through 12. Assembly 60 will not be described in further detail hereat other than to recall that the same comprises a cylindrical housing 64 enclosing an internal chamber and having an integral mounting flange 65 at one end thereof. Housing 64 supports a U-shaped yoke 70 having parallel spaced arms 71 and 72 provided with terminal mounting ears 74, 74 fixed thereto, all as previously related.

Plunger assembly 146 (shown in its assembled condition in FIGS. 17 and 26 through 28) is illustrated in detail in FIGS. 19 through 25 of the drawings as will now be described. Specifically, assembly 146 is made up of a modified integrated plunger and latching member 150, a modified tail piece 151 fitted thereto, and a single spring means 152.

The particular structural aspects of the plunger and latching member 150 are best shown in FIGS. 18 through 21 of the drawings from which it will be recognized that same is a unitary member preferably molded of semirigid plastic material, such as a resilient nylon, to define two major portions, namely, a cylindrical plunger portion 155 and a relatively movable latching portion 156. It is contemplated that such portions 155 and 156 may be of plastic, capped with metal, such as brass, to promote wearability, to avoid possible distortion of these portions and to reduce operating friction.

The plunger portion 155 of member 150 is formed with a generally cylindrical body 157 having a frontal wall 158 enclosing the outer end thereof and an internal cylindrical chamber 159 which is open at the inner end 160 of the body 157. Chamber 159 is distinguished by a coaxial cylindrical cavity 161 formed in the inside face of the frontal wall 158 and an annular recess 162 in the side wall 163 thereof.

Figure 21:
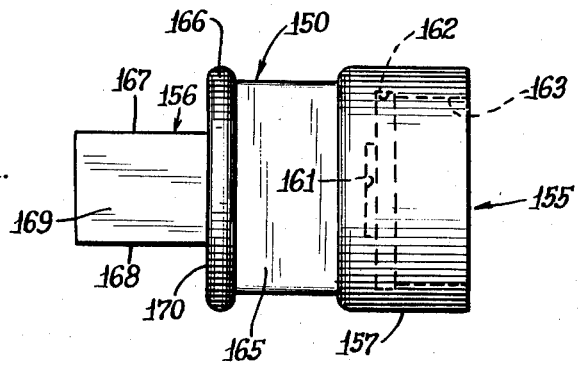
FIG. 21 is an elevational view of the latching element shown in FIG. 18.
Figure 22:
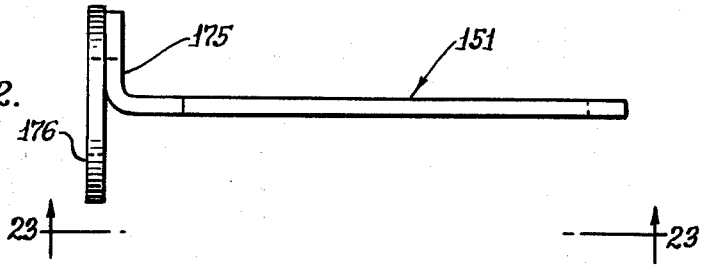
FIG. 22 is a top plan view of a tail piece used with the latching element of FIG. 18.

Formed integrally with and extending centrally outwardly from the frontal wall 158 of the plunger member is a flexible web portion 165 of generally uniform thickness and rectangular elevational configuration (see FIG. 21). Such web portion extends symmetrically of the longitudinal axis of the plunger portion 155 and merges at its outer end with a cylindrical base 166 of the latching portion 156.

It will be understood that the latching portion 156 is configured substantially identical to latching element 91 of the initially described assembly 45 of this invention. To that end the cylindrical base of the latching portion has a forwardly projecting wedge-shaped nose piece or portion formulated by a pair of triangular, parallel spaced top and bottom walls 167 and 168 (see FIGS. 19 and 21), intersected by a normally related side wall 169 extending at right angles from the planar front face 170 of base 166, and by a second side wall 171 disposed substantially at 45° with respect to such face 170 and side wall 169. It will be noted that the side wall 169 also lies parallel to the web portion 165 (see FIG. 18).

Figure 24:
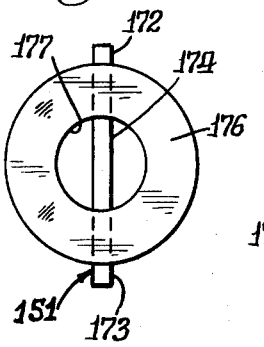
FIG. 24 is a lefthand end view of the tail piece shown in FIG. 23, taken substantially from vantage line 24—24 of that figure.
Figure 23:
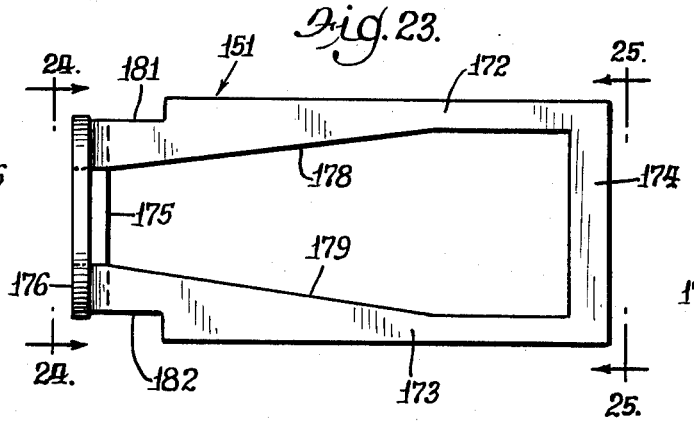
FIG. 23 is an elevational view of the tail piece illustrated in FIG. 22 looking substantially from vantage line 23—23 of that figure.
Figure 25:
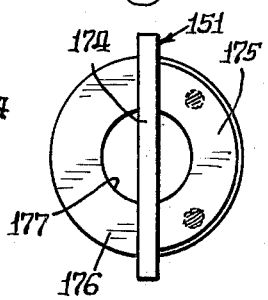
FIG. 25 is a righthand end view of the FIG. 23 tail piece, looking substantially from vantage line 25—25 of FIG. 23.

A modified tail piece, designated generally as 151 in FIGS. 22–25, comprises a rigid metal structure adapted to be interfitted with member 150. As best shown in FIG. 23, tail piece 151 is formed as a generally U-shaped member having spaced upper and lower arm portions 172 and 173 integrally interjoined at their inner ends by a transverse cross arm portion 174. The opposite or operationally outer ends of the arm portions are integrally joined by a semiannular mounting ear portion 175 (see FIG. 25) which extends laterally outwardly of one side thereof. Mounting ear portion 175 is related at right angles to the general longitudinal axis of the arm portions 172 and 173 and is adapted to be affixed as by spot welds (see FIG. 25) to a coaxially aligned retainer ring 176 formed as an annular washer having a central circular opening 177, as best shown in FIG. 24. It will be noted that the tail piece arm portions 172 and 173 have converging inner edges 178 and 179, respectively bordering an open central area shown best in FIG. 23. Such converging edges 178 and 179 slope downwardly and upwardly, respectively, to meet the perimeter of the open center of the mounting ear 175, which is aligned coaxially of retainer ring opening 177 in assembly. In addition, the arm portions 172 and 173 are further distinguished by inset rectangular shaped shoulders 181 and 182, respectively, located immediately adjacent to and extending rearwardly of the outer periphery of mounting ear 175, for purposes which will appear presently. It will be noted that the spacing of the arm portions 172 and 173 is such as to mate with the cylindrical exterior of plunger portion 155 in assembly, with the outer diameter of the retainer ring 176 being selected to mate with the annular recess 162 near the bottom end of chamber 159 therein.

With the foregoing structural relationships in mind, it will be recognized from FIG. 17, for example, that the combination plunger and latching member 150 is interfitted with the tail piece 151 by inserting the latter coaxially into chamber 159 thereof until the retainer ring 176 snaps into the annular recess 162. This interconnection is made possible by virtue of the resilient or yieldable nature of the selected plastic for member 150 and makes for a convenient and simple interconnection system, whereby the tail piece is quickly and easily interjoined with the molded member 150. It further should be noted that the inner end 160 and adjacent portions of the side walls for the plunger portion 155 fit over the outer ends of arms 172, and 173 of the tail piece, to seat in the shoulders 181 and 182 thereof.

Figure 26:
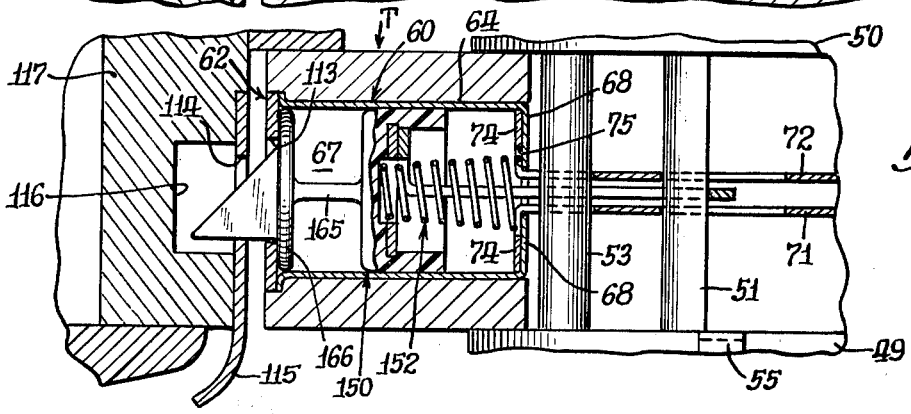
FIG. 26 is a cross-sectional view of the FIG. 17 assembly, with portions shown in plan, taken substantially along vantage line 26—26 of FIG. 17 and illustrating the operating position of that assembly in fully latched condition with a jamb mounted strike.

From examination of FIG. 17 in the drawings it will be understood that the modified plunger assembly 146 is adapted to be mounted coaxially within the housing and yoke assembly 60 over the spring means 152. As seen in FIGS. 17 and 26, for example, the illustrated spring means 152 is formed as a frusto-conical compression spring in which the coil loops gradually increase in diameter from the outer end to the base bend thereof. The smaller diameter end of spring 152 seats in the cylindrical cavity 161 formed at the outer or bottom end of chamber 159 in the plunger portion 155, while the opposie end thereof is located in the spring seat 75 and abuts the end wall portions 68, 68 of the plunger housing 64; extending coaxially through opening 177 of the retainer ring 176 (see FIGS. 26–28). In assembly, the small end of spring 152 is inserted in the cavity 161 and then with the plunger assembly dropped into chamber 67 of the housing assembly 60, locating the larger end of the spring in spring seat 75, as above noted. The face plate 62 is then affixed over the outer end of chamber 67 and riveted to flange wall 65, in the manner described heretofore in conjunction with assembly 45.

Having thus described the elements and portions of the second modified bolt assembly 145, it will be readily understood the same is adapted to be mounted in the bore 42 of the door with the face plate and mounting flange affixed to the door edge by means of the mounting screws 111, as in the previously described assemblies.

Operation of Second Modified Embodiment

Figure 27:
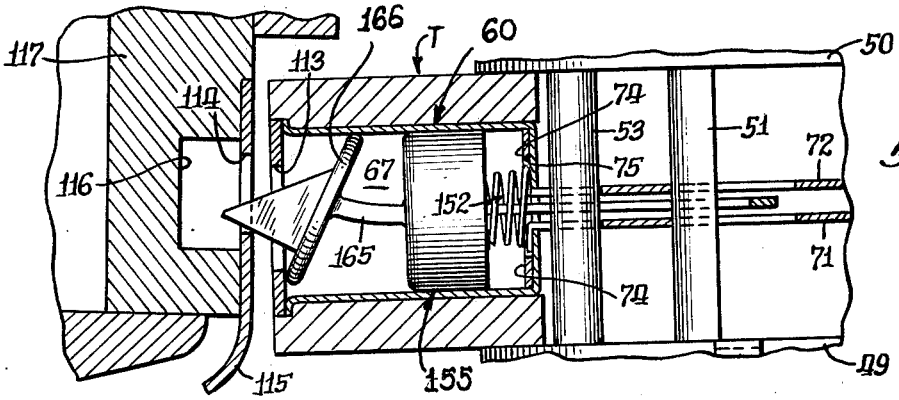
FIG. 27 is another cross-sectional view, similar to FIG. 26, showing an initial position of parts for the FIG. 17 assembly during force imposed unlatching operation.
Figure 28:
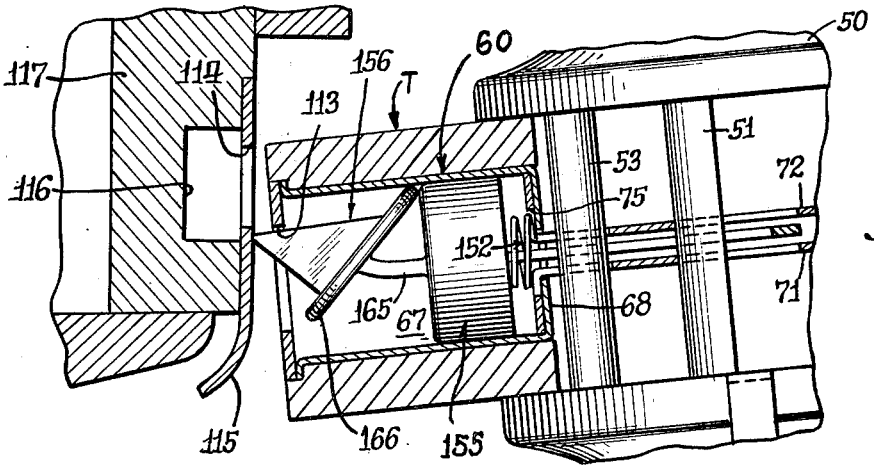
FIG. 28 is another cross-sectional view, similar to FIG. 27, showing the unlatched condition of the FIG. 17 assembly.
Figure 19:
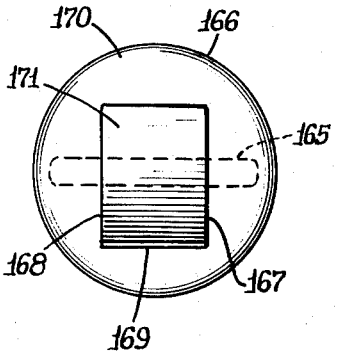
FIG. 19 is a lefthand end view thereof taken substantially from vantage line 19—19 of FIG. 18.
Figure 18:
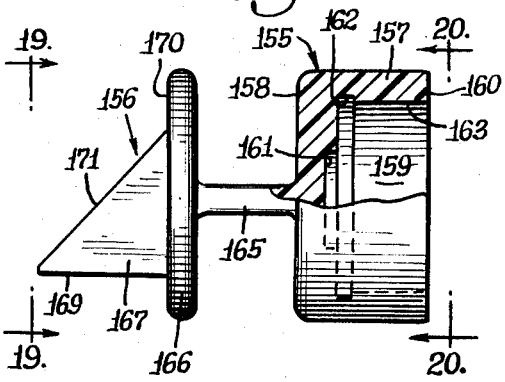
FIG. 18 is a plan view with portions broken away in section, of the latching element embodied in the FIG. 17 assembly.
Figure 20:
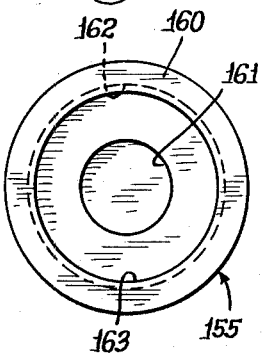
FIG. 20 is a righthand end view thereof, taken substantially from vantage line 20—20 of FIG. 18.

With particular reference now to FIGS. 26 through 28 of the drawings, the use and operation of the modified assembly 145 will now be described in association with the successive operational views therein set forth. As specifically illustrated in FIG. 26, assembly 145 is shown in its fully latched condition with the combined plunger and latching element member 150 advanced against the inside of face plate 62 so that the nose end of the latching portion 156 thereof extends through face plate opening 113 and enters opening 114 of the strike 115, thus securing the door 40 in closed latched condition. As in the previously described cases, the operating spindle 51 is in a locked state in FIGS. 26–28, thereby preventing manual unlatching operation of the bolt assembly 145.

As shown in FIG. 27, if it is desired to open the locked door in an emergency situation, the imposition of thrust forces T against the outside face of door 40 imparts rotational movement to the plunger assembly's latching portion 156 thereby causing web wall 165 to flexibly bend, as viewed in that figure. Simultaneously, slight rearward or inward axial movement of the plunger portion 155 and attached tail piece 151 occurs to compress spring means 152 in the process. Such rotational activity of the latching portion is brought about by virtue of the interengagement between face wall 169 thereof and the adjacent side edge of the strike opening 114, as the door 40 moves in an opening direction.

Continued imposition of opening force on the door, as illustrated in FIGS. 27, 28 effects additional rotation of the latching portion 156 and flexing of web wall 165 until the leading face wall 169 thereof is disposed at substantially 45 degrees across the adjacent edge of the strike opening 114. In that condition continued door opening movement generates inward translation of the plunger assembly 146, compressing spring means 152. When sufficient inward translation of the plunger assembly has taken place, the latching portion fully escapes the strike opening 114 and permits the door to open, as best shown in FIG. 28.

It especially is to be noted in regard to the described rotational movement of the latching portion relative to the plunger portion, that during such activity the web wall 165, which integrally interjoins such latching and plunger portions, bends with resilient, yielding action and also serves to transmit thrust to the plunger portion to compress the spring means 152.

Once the door 40 is open, the expanding activity of the spring means 152, coupled with the tendency of the web wall to return to its normal non-flexed state, operate to return the plunger assembly to its latch engaging position for re-engagement with the strike; moving the nose piece or portion through opening 113 in the face plate while reversing the rotational movement of the latching portion until the same resides in latching position.

While the web wall portion 165 has been hereinabove described as being of a resilient nature so as to permit the controlled rotational movement of the latching portion, it is fully contemplated that in certain instances it may be desirable to construct the combination latching and plunger member 150 of relatively rigid material, such as a hard nylon or metal. In such a structure the web wall 165 will not bend and is provided with an indentation whereby to purposely fracture or break the same at initiation of the emergency opening operation of the door. Such a breakable or fracturing structure allows the latching portion to escape the strike for emergency door opening, but requires replacement of the latch assembly 145 once the same has been cycled through an emergency opening operation, as described.

Third Modified Form

Turning now to the particulars of a third modified embodiment of this invention, reference is made to FIGS. 29 through 37 of the drawings from which it will be understood that a modified bolt assembly 185 there shown is designed for installation on a typical interior door 40, in the same manner as heretofore described in association with bolt assemblies 45, 125 and 145. That is to say, assembly 185 is designed to be mounted in the bore 42 extending inwardly of the free edge 43 of door 40, and is operationally associated with the manual operator assembly 46 as previously related.

In general, the modified assembly 185 comprises a modified plunger housing and yoke assembly 186 and a modified plunger assembly 187, which are held in coaxial assembled relationship by a face plate 62, to cooperate with the jamb mounted strike 115 having latch opening 114 and disposed over the socket recess 116 formed in jamb member 117, being attached thereto as by screw means 118, as heretofore related.

As best shown in FIGS. 32 through 34 of the drawings, the housing and yoke assembly 186 is substantially identical with the first described housing and yoke assembly 60 and as such comprises the tubular plunger housing 64 having an internal cylindrical chamber 67 and adapted to fit the transverse bore 42 extending inwardly of the free edge 43 of the door. The outer end of the plunger housing is distinguished by a radially projecting mounting flange wall 65 drawn integrally therewith and of generally rectangular profile as best illustrated in FIG. 33. The opposite or operationally inner end of the plunger housing is provided with radially inwardly extending inner end wall portions 68, 68 which are separated by a central, generally rectangular shaped opening for the reception of the U-shaped yoke member 70, all as previously described. It will be recalled that the yoke comprises parallel spaced arm portions 71 and 72 interjoined at their inner ends by a cross connecting wall portion 73 and having semiarcuate mounting ears 74, 74 at their outer ends, as previously described. The two parallel arms 71, 72 of the yoke are each provided with openings 76, 77, and 78, in the manner heretofore related, for the passage of the operating spindle 51, mounting screws 52 and mounting bosses 53, respectively, of the manual operator means 46.

It will be recognized that up to this point, the modified plunger housing and yoke assembly 186 is for all intents and purposes identical to the corresponding assembly 60 of the first described preferred embodiment 45 of this invention. The specific modification in assembly 186 thereover resides particularly in the provision of a generally bullet-shaped spring guide 188 fixed to one of the mounting ears 74 of the yoke member, as by brazed or riveted connection, so as to extend into chamber 67 in axial parallelism with the longitudinal axis of the plunger housing 64. (See FIGS. 32 and 34, in particular). The specific purpose and operational significance of this spring guide will be better understood in association with the following description of the plunger assembly 187.

As best shown in FIGS. 30 and 31, the plunger assembly 187 comprises a generally cylindrical metal plunger member 189 bifurcated at its outer end by a transversely extending opening formed symmetrically of the plunger's longitudinal axis and of a size to accommodate the mounting of a latching element 190 between separated arcuate shaped end portions 191, 191 thereof (see FIG. 31). At the opposite or inner end of the plunger member and to one side of its longitudinal axis is a cylindrical blind bore spring socket 192 receptive at one end of a compression plunger spring means 193 (see FIG. 29), whereby the latter extends rearwardly of the inner end of the plunger member in confronting relationship with the above-mentioned bullet-shaped spring guide 188.

As best illustrated in FIGS. 29 and 30 of the drawings, plunger member 189 is fitted with a U-shaped tail piece 194 having parallel spaced elongated arms 195, 195 cross connected at one end by arm 196, which is operationally engaged by the operator spindle 51, similar to the previously described tail piece of bolt assembly 45. The tail piece fits into slotted openings (unnumbered) formed in the inner end of the plunger member and is brazed in place so as to extend rearwardly therefrom in coplanar symmetry with the longitudinal axis of the plunger member and in parallelism with the spring socket 192 therein.

The latching element 190, as best shown in FIGS. 29–31, is mounted between the separated bifurcated end portions 191, 191 at the nose or outer end of the plunger member and is formed as a unitary metal member having an irregular quadrangular plan profile, distinguished by an open sided interior extending symmetrically lengthwise of its longitudinal axis to provide a substantially U-shaped cross sectional configuration therefor (see FIG. 31). This structural arrangement defines a pair of parallel spaced, operationally upper and lower quadrangular shaped wall portions 197, 197, transversed by a rectangular shaped planar front wall portion 198, integral therewith as best shown in FIG. 31. It will be noted that the wall portions 197, 197, are identical and project in superposed spaced relation at right angles to the front wall portion 198. Each thereof has one side edge surface 200 which intersects front wall portion 198 at approximately 45° to define a wedge shaped nose configuration for the latching element. Each of the wall portions 197 further is distinguished by a pair of intersecting base edge surfaces 201 and 202, one of which extends at right angles to edge 200 thereof, and the other of which extends at right angles to the front wall portion 198, with their area of intersection being radiused as shown.

The latching element is pivotally mounted for movement relative to the plunger member by means of a pivot pin 203 which extends through aligned openings in the semiarcuate end portions 191, 191 of the plunger member and the parallel spaced walls 197, 197 of the latching element. Pin 203 is in coplanar alignment with the tail piece and at right angles to the longitudinal axis of the plunger member. The latching element, as best illustrated in FIG. 30 is normally held in an extended or latching position with the base edge surface 202, 202 of its wall portions 197, 197 against the bottom wall 205 of the plunger member's slotted opening by means of a latching spring 206. Spring 206 has one or more central coils about the pivot pin 203 and oppositely extending terminal end portions 207 and 208, engaging the inside face of the latching element's front wall 198 and the bottom wall 205 of the plunger member's slotted opening, respectively. With this arrangement the latching element is normally biased into its extended position, as illustrated in FIG. 30, but is permitted to partially rotate about pin 203 relative to the plunger member.

Having thus described the modified housing and yoke assembly 186 and its cooperating plunger assembly 187, it will be understood that the same are adapted to be coaxially interfitted, with the plunger member 189 disposed within chamber 67 of the plunger housing 64; the spring socket 192 being aligned coaxially with the projecting spring guide 188 to maintain the plunger spring 193 therebetween. The face plate 62, as previously described in association with the assembly 45, is then affixed over the mounting flange 65 of the housing assembly by upsetting the rivet portions 112 thereon, as previously related. It will be noted that when so assembled, the latching element 190 is held outwardly through the opening 113 in the face plate by the biasing activity of the plunger spring 193, which forces the plunger member against the inside wall of the face plate, as shown in FIG. 29. Thus assembled, the modified latch bolt assembly 185 is adapted to be inserted in edge bore 42 of the door and fixed in operational position on the latter by means of the mounting screws 111 which pass through the face plate 62 and the mounting flange 65, all as previously related. Once assembly 185 is so installed in the door, the operator assembly 46 is positioned over the enlarged door opening 41, with the operator spindle, mounting screws and mounting bosses 51, 52 and 53, respectively, extending through the yoke member and the open interior of the U-shaped tail piece, as previously related.

Use and Operation of the Third Modified Embodiment

Figure 35:
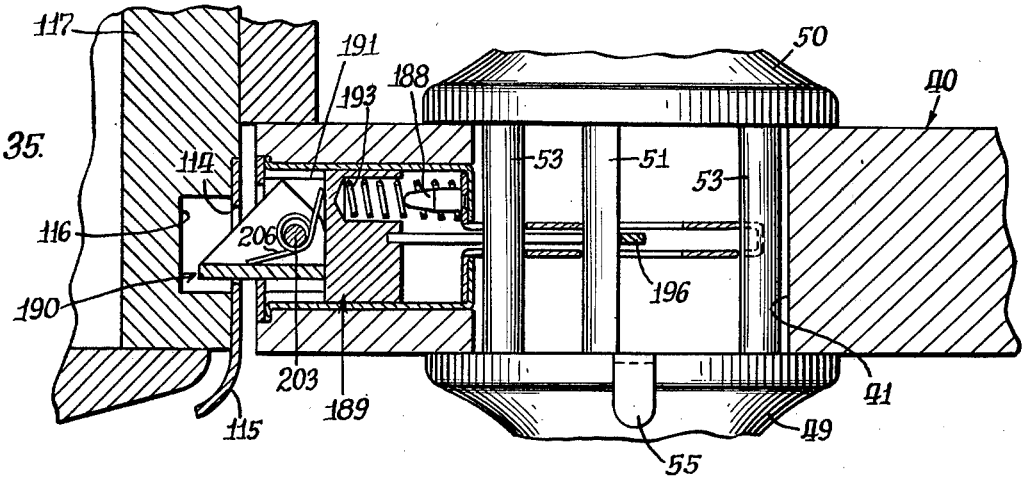
FIG. 35 is a cross-sectional view taken substantially along vantage line 35—35 of FIG. 29 and looking in the direction of the arrows thereon, to illustrate the operational position of parts for the FIG. 29 assembly in latched condition with a jamb mounted strike.
Figure 36:
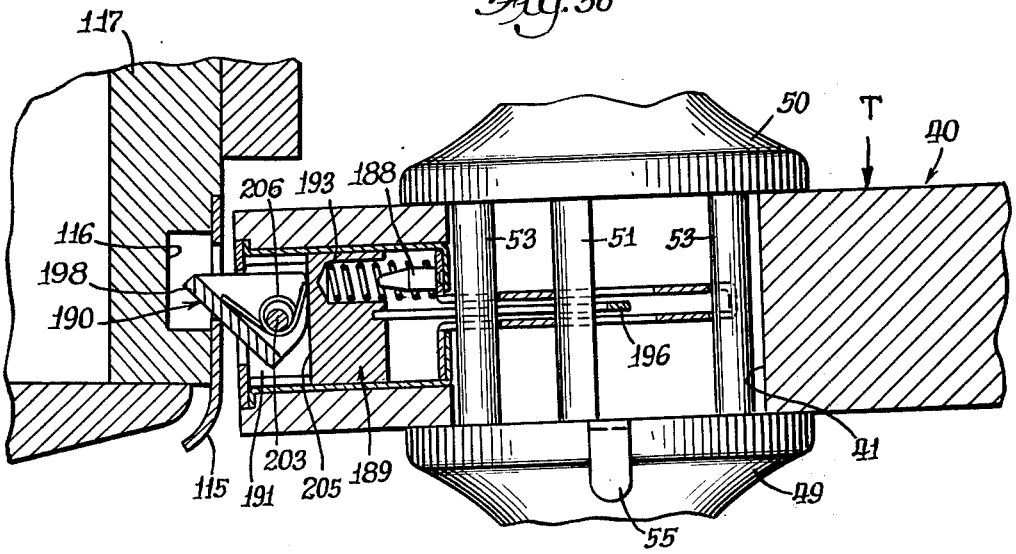
FIG. 36 is another cross-sectional view of the FIG. 35 assembly, illustrating an initial position of parts during force imposed unlatching operation.
Figure 37:
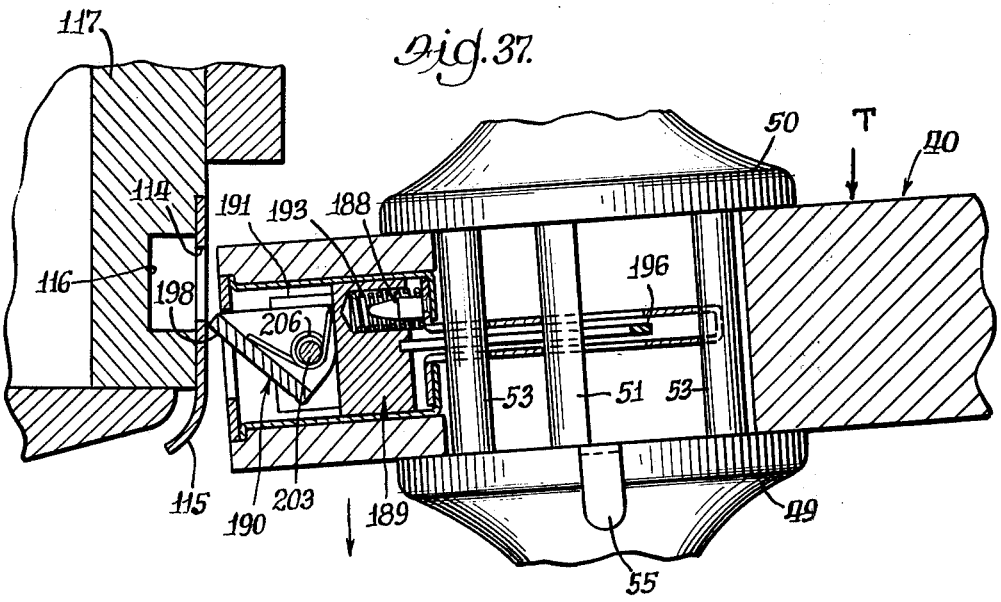
FIG. 37 is still another cross-sectional view, similar to FIG. 36, illustrating the FIG. 35 assembly in unlatched condition.

With special reference to FIGS. 35 through 37 of the drawings, it will be recognized that the modified assembly 185 is therein illustrated in latched and various operational positions during force imposed unlatching operation. As in the previously described embodiments, the illustrated condition is one in which the operating spindle 51 is locked against rotation, thereby preventing manual operation of the bolt assembly 185.

In that context, it will be appreciated that in FIG. 35 the bolt assembly 185 is shown in its fully latched condition with strike 115 and the door 40 locked in closed condition. As related in the previously described embodiments of this invention, imposition of opening forces on the door 40, such as thrust forces T against the outside face thereof or pulling forces on the inside thereof, causes clockwise pivotal response of the latching element 190 about pin 203, as viewed in FIG. 36. This pivotal reaction of the latching element is brought about by reason of the interengagement of its front wall 198 with the adjacent edge of the strike opening 114. In the particular illustrated case, such pivotal movement of the latching element continues until the base edges 201, 201 thereof bottom against wall 205 of the plunger member, at which time the latching element's front wall 198 is disposed substantially at 45° across the latch plate opening, as shown in FIG. 36. This pivotal activity of the latching element is yieldably opposed by the latching spring 206. It is to be noted that during initial pivoting operation of the latching element, the plunger member, its attached tail piece, and plunger spring 193 may remain relatively at rest (see FIGS. 35 and 36), although such static condition probably obtains only briefly in this as well as in the previously described embodiments of the invention.

Continued imposition of thrust T on the door 40, as illustrated in FIG. 37, effectively moves the latching element across the adjacent edge of the strike opening 114, assisted by the angulated plane of its front wall portion 198 relative to the adjacent edge of opening 114. Resultant forces translate the plunger assembly away from the strike, compressing the plunger spring 193 until the latching element escapes strike 115.

As soon as the latching element has cleared the strike, the plunger and latching element return to their normal latching or extended positions.

Thus it will be seen that the third modified form of this invention also accomplishes the desirable objective of this invention by affording emergency opening operation of a latched or locked door in response to the imposition of forces transversely of the normal operating axis for the bolt assembly.

From the above detailed description of the several forms of this invention, it is believed that those of ordinary skill in this art will recognize its inventive advancement over the prior art and readily appreciate that its basic concepts and teachings are not restricted to the particulars of the described embodiments, but are readily applicable to equivalent structures and installations, such as surface mounted security bolts or latches, and similar installations wherein emergency or panic door opening operation is desired. Consequently, it is intended that the above described invention be unlimited by the foregoing disclosure except as may appear in the following appended claims.

The embodiments of the invention in which an exclusive property or privilege is claimed are defined as follows:

1. In a privacy lock or latch set for installation on interior doors of the class having an operator mechanism mounted through the door and provided with manually engageable knob means on opposite sides of the door for actuating a reciprocating latch bolt carried in a housing mounted so that actuation of the operator mechanism retracts the latch bolt inwardly of a vertical door edge to withdraw the same from door latching engagement with a jamb mounted strike plate, the operator mechanism having selectively operable locking means to prevent retraction of the latch bolt whereby to lock the door in a latched position; an improved latch bolt assembly normally responsive to actuation of the operator mechanism, but capable of strike disengaging activity to unlatch the door when the operator mechanism is locked, comprising: a plunger member mounted to reciprocate within said housing, link means positively interconnecting said plunger member with the operator mechanism for actuation thereby, a latching element mounted to reciprocate with said plunger member and having a nose portion normally projecting beyond the outer end of said member and door edge for latching engagement with the strike plate, and means carried by said plunger member for uniformly supporting and controlling said element for limited pivotal movement such that the application of predetermined opening force on the locked door pivotally actuates said element to retract said nose portion from said strike plate and release the locked door.

2. The combination of claim 1 in which said latching element is mounted for limited pivotal movement about an axis aligned transversely to its path of movement with the plunger member.

3. The combination of claim 1, in which said means for supporting and controlling said element comprises a spring biased cup member slideable within said plunger member and abuttingly engaged with said element.

4. The combination of claim 1, and yieldable means opposing pivotal actuation of said element to retract said nose portion.

5. The combination of claim 1, said means for supporting and controlling said element being yieldable.

6. The combination of claim 1 in which said means for supporting and controlling said element is formed by an integral connection.

7. The combination of claim 1, wherein said latching element comprises a bell crank pivotally supported for movement about an axis transverse to and offset laterally of the movement axis of the plunger member.

8. The combination of claim 1, wherein pivotal actuation of said element in a direction to retract said nose portion produces subsequent movement of said plunger member and link means in an unlatching direction.

9. The combination of claim 1, and stop means for limiting pivotal movements of said latching element.

10. The combination of claim 1, and first yieldable means operationally opposing movement of said plunger member and link means in an unlatching direction, and second yieldable means opposing pivotal movement of said element in a direction to retract said nose portion.

11. The combination of claim 10 wherein said first and second yieldable means comprise a single resilient member operable to oppose both said relative unlatching movement of said latching element and unlatching movement of said plunger member.

12. The combination of claim 10 in which said means for supporting and controlling said element comprises pivot means aligned transversely of the plunger members axis of movement.

* * * * *

UNITED STATES PATENT OFFICE

CERTIFICATE OF CORRECTION

PATENT NO. : 4,135,746

DATED : January 23, 1979

INVENTOR(S) : JOHN G. STERLING

It is certified that error appears in the above-identified patent and that said Letters Patent are hereby corrected as shown below:

Col. 2, line 36, "assembly" should be--subassembly--.

Col. 8, line 9, "10" should be--110--.

Col. 11, line 21, "13 c( 16" should be--13-16--.

Col. 20, line 37, after "1" insert--wherein--.

Col. 20, line 38, after "element" insert--are-- and take out "being".

Signed and Sealed this

*First* Day of *May 1979*

[SEAL]

*Attest:*

RUTH C. MASON
*Attesting Officer*

DONALD W. BANNER
*Commissioner of Patents and Trademarks*